United States Patent [19]

Blakley et al.

[11] Patent Number: 5,044,762

[45] Date of Patent: Sep. 3, 1991

[54] MIXER APPARATUS FOR HIGH HORSE POWER MIXER APPLICATION WHERE MIXER COMPONENTS OF LARGE WEIGHT AND SIZE ARE SUPPORTED

[75] Inventors: Robert A. Blakley; Donald G. Schirtz, both of Rochester, N.Y.

[73] Assignee: General Signal Corporation, Stamford, Conn.

[21] Appl. No.: 633,915

[22] Filed: Dec. 26, 1990

[51] Int. Cl.[5] ..... B01F 7/22

[52] U.S. Cl. ..... 366/286

[58] Field of Search ..... 366/279, 281, 282, 283, 366/284, 285, 286, 289, 241, 242, 244, 245, 247, 249, 250, 251, 261

[56] References Cited

U.S. PATENT DOCUMENTS

| | | | |
|---|---|---|---|
| 2,319,821 | 5/1943 | McLean | 366/286 |
| 3,115,333 | 12/1963 | Lennon | 366/286 |
| 3,149,888 | 9/1964 | Lennon | 366/285 |

*Primary Examiner*—Robert W. Jenkins

*Attorney, Agent, or Firm*—Martin Lukacher; Milton E. Kleinman

[57] ABSTRACT

Mixer apparatus including a high horsepower motor and transmission drive for an impeller, together with associated shafts, impellers and a bearing and seal assembly, are supported on a tank without excessive loading and vibration of the top head of the tank and without special construction to support the apparatus from the foundation. The support structure of the mixer apparatus is provided by a machine base having connected beams on which the motor and the transmission (gear box) are located. A noise containment enclosure on the base may be used to lower radiated noise levels. The impeller shaft and shaft extensions thereof are disposed in telescoping relationship with the transmission, aligned along the same axis. The machine base is parallel to the foundation and is supported on vertical columns, which depend from one end of the base and from opposite ends of a cross beam at the other end of the machine base. The columns distribute the load of the mixer on the side wall of the tank which has a high section modulus which provides the rigidity and stiffness to prevent vibration of the apparatus. A mechanism, including hydraulic cylinders is carried in a bearing member, which contains the bearings and seals. The cylinders lift the impeller, moving it upward through the transmission so as to enable detachment of the impeller shaft from the seal unit to facilitate seal replacement.

15 Claims, 8 Drawing Sheets

MIXER APPARATUS FOR HIGH HORSE POWER MIXER APPLICATION WHERE MIXER COMPONENTS OF LARGE WEIGHT AND SIZE ARE SUPPORTED

DESCRIPTION

The present invention relates to mixer apparatus and particularly to large, heavy and high horsepower mixer apparatus for industrial applications.

The invention is especially suitable for use in providing apparatus for mixing or agitating materials in large closed tanks, where materials at high pressure and temperature are contained. The invention also provides an assembly in which the mixer motor and transmission, bearings and seals are separately located, which facilitates accessibility thereto for ease of maintenance, repair and replacement, which assembly may find application in other mixers than the heavy, large, high horsepower mixers in which the invention is especially suitable for use.

The mixers to which the invention is especially applicable can have motors of about seven hundred horsepower rating and heavy transmissions (gear boxes) which reduce the motor speed and increase the output torque so as to enable large batches of materials to be mixed and/or agitated. An impeller shaft driven by the motor through the transmission rotates one or more impellers and is located in a vessel (tank) containing the materials. These materials may also be at high temperature and pressure which must be contained in the vessel while mixing and agitating is carried out. The size of the mixers for these high horsepower applications can be 10 to 15 feet long and 9 to 15 feet wide and high. It follows that the weight (load) which must be supported is very large, for example, over 80,000 pounds. The tanks are supported on foundations, the tanks being 36 or more feet high and 12 or more feet in diameter.

It has been the practice to support the mixer on the top head of the vessel with the mixer shaft extending into the vessel. Such supports have been found satisfactory for mixers up to about 200 horsepower and about 10,000 pounds in weight. The loads, both the bearing loads and the dynamic loads for larger mixers have engendered serious problems when top head loading was attempted. The top head stiffness is limited and is, therefore, somewhat flexural. Due to the large diameter rotating members in the motor and transmission and also due to the bending loads on the mixer shaft, the mixer apparatus and the top head vibrate. This vibration appears as rocking motions. Components may work loose or wobble. The vibrations can also produce fatigue failure modes.

The alternative of using special construction to support the mixer from the foundation is unsatisfactory because of the high cost of the construction; steel sufficient for a building of several stories in height being required. Moreover, the construction takes a large amount of floor space, which is at a premium in the factories and plants where the vessels are located and where the mixers must be used. Vibrating mixers radiate noise. The large, high horsepower mixer components also generate noise at undesirably high levels as they rotate. Containment of this noise is desirable for environmental, health and safety reasons.

It is the principal object of the present invention to provide improved mixer apparatus especially suitable for use in high horsepower, heavy, large mixer applications wherein the apparatus is supported in a manner to reduce vibration and without the need for special construction.

It is another object of the invention to provide mixer apparatus having an improved support structure which avoids the need to rest the weight of the mixer apparatus on the top head of the tank or vessel associated therewith.

It is a further object of the present invention to provide improved mixer apparatus wherein the motor couplings, transmission, seals and bearings of the mixer are supported in a manner to provide accessibility to these components for ease of maintenance and particularly for replacement of seals.

It is a still further object of the present invention to provide improved mixer apparatus adapted for use with a vessel, the apparatus having a support structure which transfers the downward load to the straight sides of the vessel thereby transferring 70% or more of the mixer weight and torsional loads to the foundation on which the vessel rests and avoiding special frameworks or other construction around the vessel to support the mixer.

It is a still further object of the present invention to provide improved mixer apparatus where portions of an impeller shaft assembly which are rotated by a transmission are disposed in telescoping relationship with the transmission so that the shaft assembly is adapted to be raised by internal lifting means, such as hydraulic cylinders, without the need for external cranes or special lifting apparatus.

Briefly described, mixer apparatus embodying the invention is supported by a support structure on a vessel. The apparatus itself includes an impeller attached to an impeller shaft driven by a motor through a transmission which apparatus presents static and dynamic, vertical and torsional loads. The vessel has a side wall and a base resting on a foundation. The vessel also has a top head. The loads, due to the mixer apparatus, are greater than what the top head can support without vibration, excessive deflection and stress during mixing of the material in the vessel. The support structure of the invention eliminates such vibration to a substantial extent. This structure has a machine base on which the motor and transmission are disposed and from which the mixer impeller shaft extends into the vessel and locates the impeller therein. A plurality of columns extend vertically in the same direction as the impeller from the base to a plurality of locations spaced from each other around the periphery of the side wall of the vessel. These columns have ends which present connections to the wall of the vessel for distributing the load through the wall to the foundation. The wall has a high moment of inertia and, therefore, presents a stiffness sufficient to prevent excessive vibration due to the loads from the mixer apparatus. An enclosure for noise containment may be disposed on the base over the motor and transmission. The impeller shaft assembly has a spindle which is disposed in driving relationship with the transmission and also in telescoping relationship therewith allowing tank expansion (due to elevated pressure and temperature) to occur without overloading various machine components such as bearings, thereby extending their life. A member supports the bearings and seal of the mixer apparatus and contains lifting means which are actuated for lifting the shaft and telescoping it through the transmission thereby allowing the shaft to be disconnected so that the seal could be removed and replaced. All other parts of the assembly are separating disposed on the base member or below the base member and are readily accessible, for ease of maintenance.

The foregoing and other objects, features and advantages of the invention, as well as a presently preferred embodiment thereof, will become more apparent from a reading of the following description in connection with the accompanying drawings in which.

Figure 1:
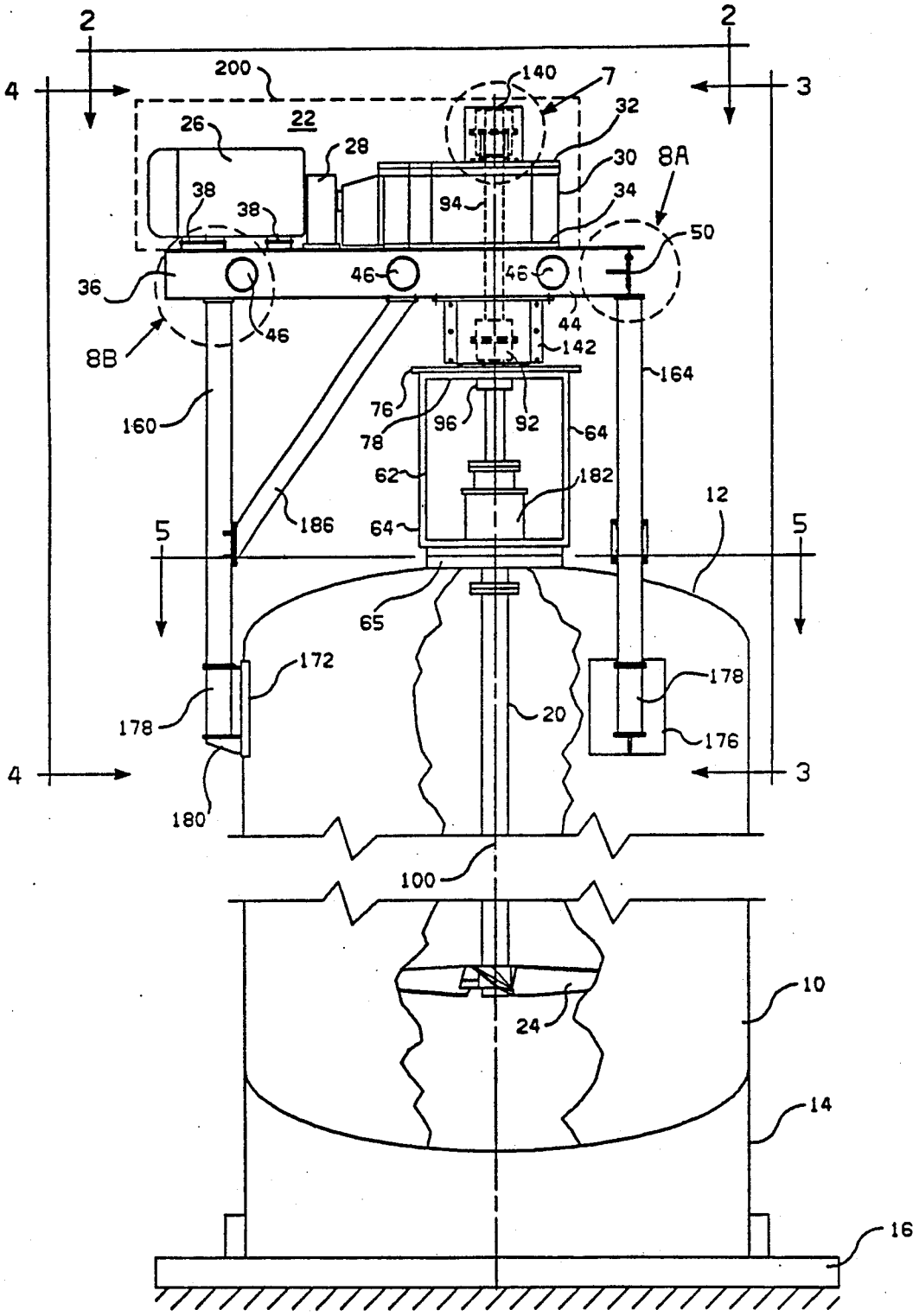
FIG. 1 is an elevational view of a mixer apparatus embodying the invention; mounted on a vessel.

Referring to FIG. 1, there is shown a vessel 10 having a top head 12 and a base 14. The base 14 is nested on a foundation 16. The vessel may, for example, be 36 feet tall and approximately 33 feet in diameter. The side wall of the vessel is cylindrical. The vessel may, for example, be steel, several inches thick and clad with a corrosion resistive material such as titanium. The vessel may be adapted to contain, for mixing or agitation, materials which are at high temperature and pressure. These pressures are maintained in containment in the tank by a seal assembly 18 through which the impeller shaft 20 of the mixing apparatus 22 extends. There may be one or more impellers 24 on the shaft 20.

Figure 3:
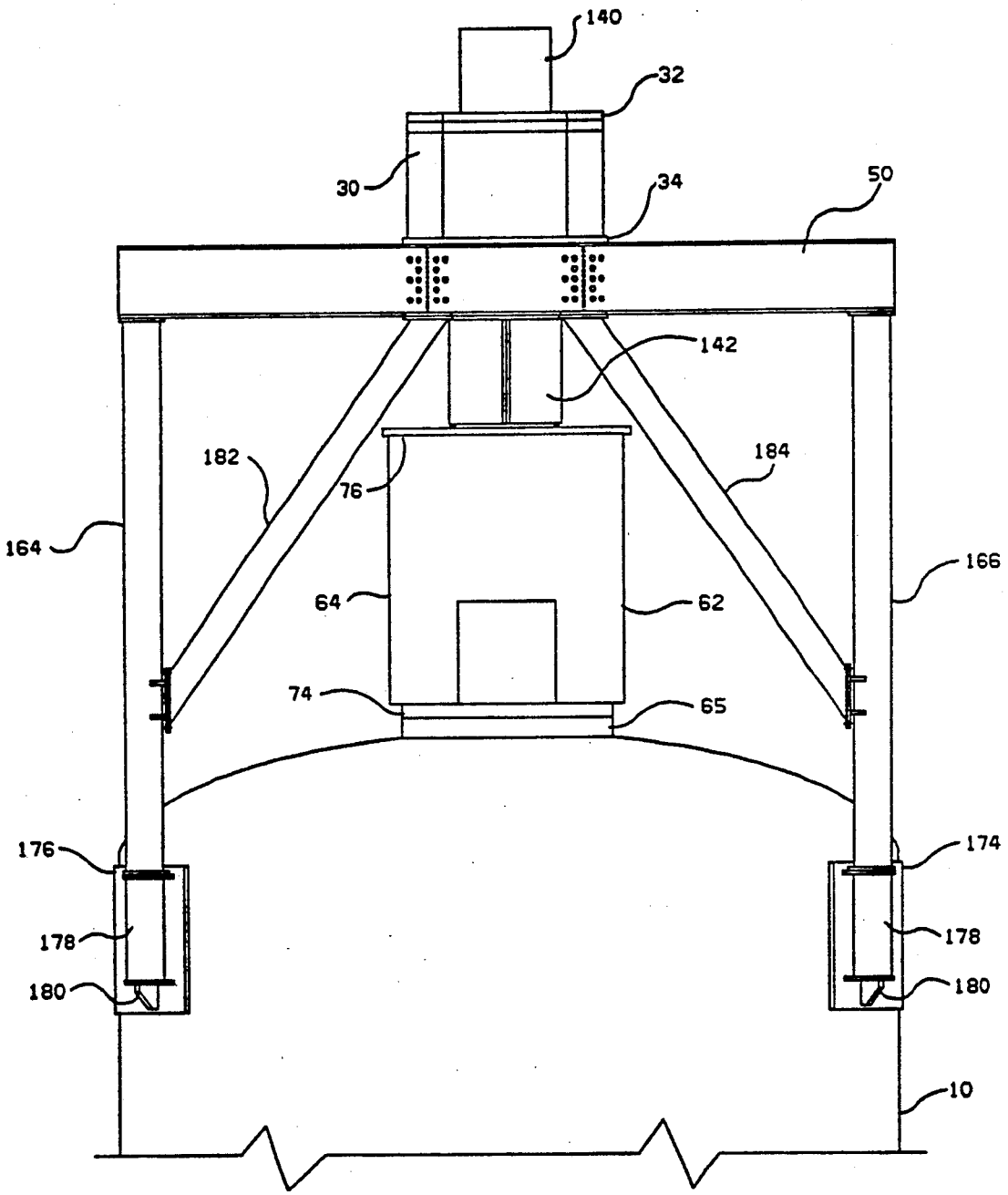
FIG. 3 is a view of the apparatus from one side, taken along the line 3—3 in FIG. 1.
Figure 4:
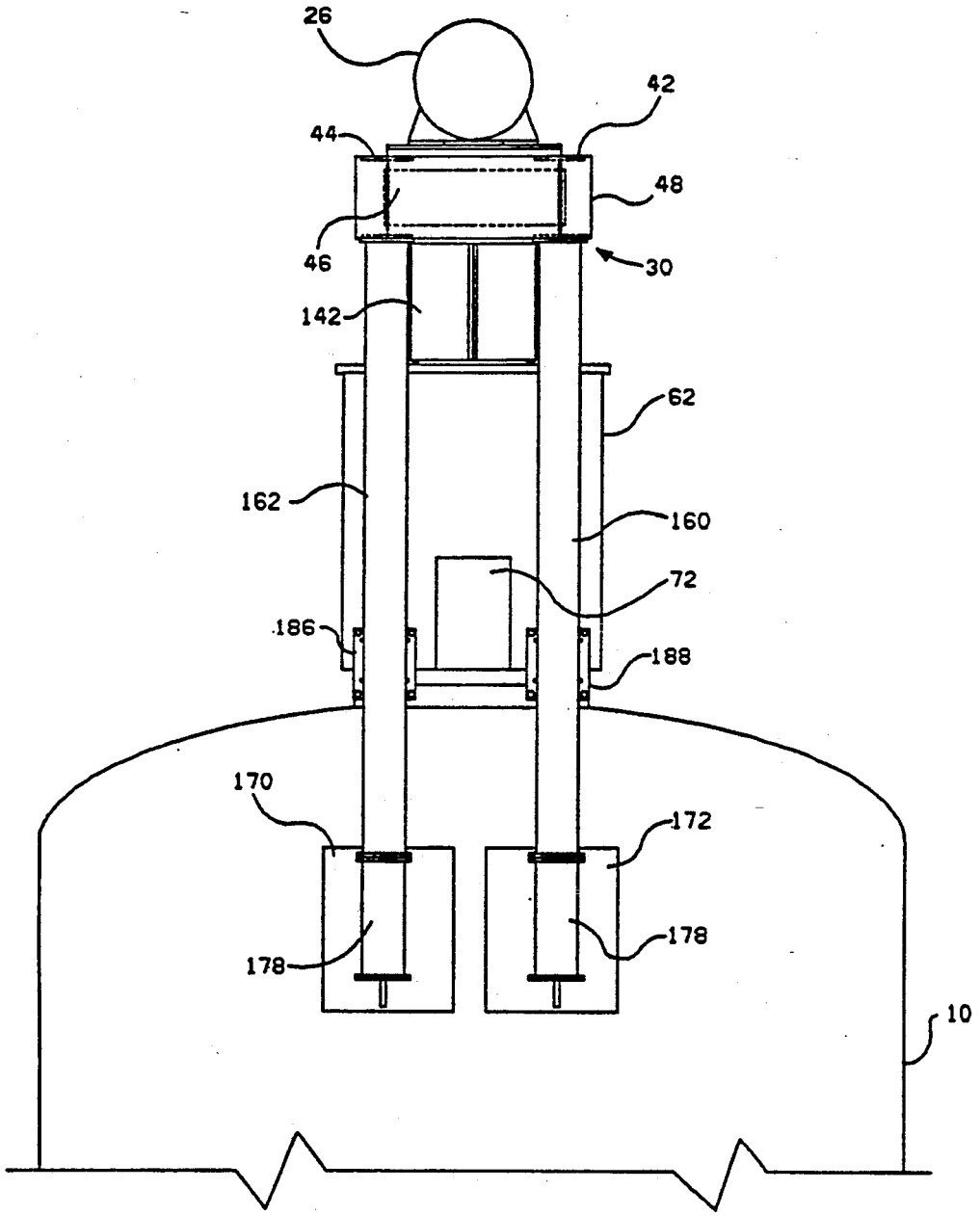
FIG. 4 is a view from the opposite side taken along the line 4—4 in FIG. 1.
Figure 8A:
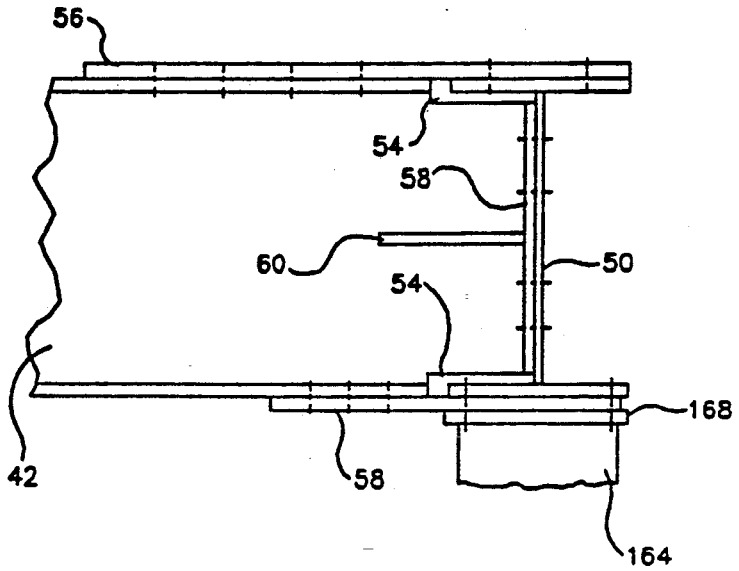
FIG. 8A and 8B are enlarged views of the areas enclosed by the dash lines 8A and 8B in FIG. 1.
Figure 8B:
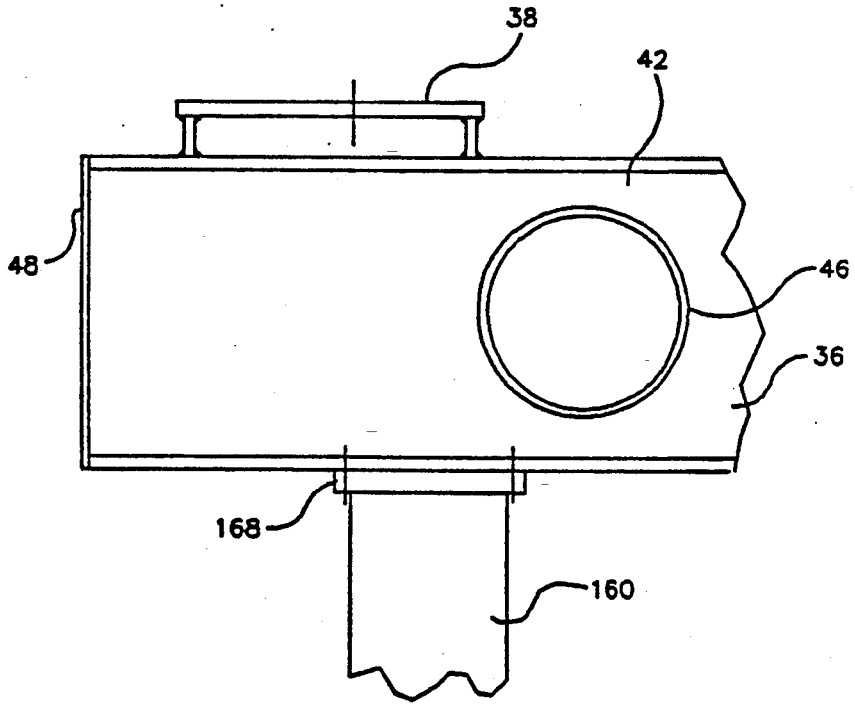

The mixer apparatus has a drive for the impeller shaft provided by a motor 26, the output shaft of which is coupled via a flexible coupling 28 to a transmission 30 contained in a gear box. The gear box has a top 32 and a base plate 34, referred to as a machine base 36. The motor 26 is mounted on motor mounts 38 to the base 36 (see also FIG. 8B). The base plate 34 of the gear box is also mounted on the machine base, as is the base of the coupling guard on the coupling 28. The size and weight of this combination of components is very large. For example, the motor may be a 700 horsepower motor, several feet (e.g., 4–6 feet) in diameter and several (e.g., 6) feet long and weighs 17,700 lb. The gear box may be ten feet long and four feet high. It is also almost as wide as the machine base (see FIG. 2) and may weigh 18,000 lb. typically. The machine base has a trunk portion 40 which is made up of a pair of laterally spaced I beams 42 and 44. The I beams have top and bottom flanges and webs. Between the webs and spacing the beams apart are cylindrical torsion tubes 46 (see also FIGS. 4 and 8B) providing the required torsional rigidity to minimize distortion of the gearbox housing which would cause subsequent misalignment of the gears. The opposite ends of the beams 42 and 44 are covered, the left end by a plate 48 and the right end by a cross beam 50. This cross beam can also be an I beam which is centrally disposed, bisecting the center line 52 of the trunk member of the machine base 36 (see FIG. 2 and 3). The connection of the cross beam 50 is obtained by notching or coping the right end of the trunk beams 42 and 44 (see FIG. 8A at 54). Splice plates 56 and 58 are bolted to the flanges of the beams and end plates clips 58 with gussets 60 are welded to the right ends of the I beams. The cross beams are bolted to the clip plates and splice plates to provide with the trunk 40, a strong, rigid assembly which constitutes the machine base 36.

The invention makes advantageous use of the high section modulus and high moment of inertia of the side wall of the tank 10. Here, the tank is stiffest. The mixing apparatus is attached to the side walls in a manner whereby 70% or more of the weight thereof is carried by the side walls and transferred therethrough to the foundation 16. No additional construction is necessary which would occupy additional space about the tank 10 and require a construction effort tantamount to erecting steel for building. Since the movement of inertia is high, the stiffness presented to the mixing apparatus is high and vibration is minimized. Such vibration would occur if the mixer apparatus were mounted on the top head 12 due to trunion type loading in the center of the top head 12.

Figure 5:
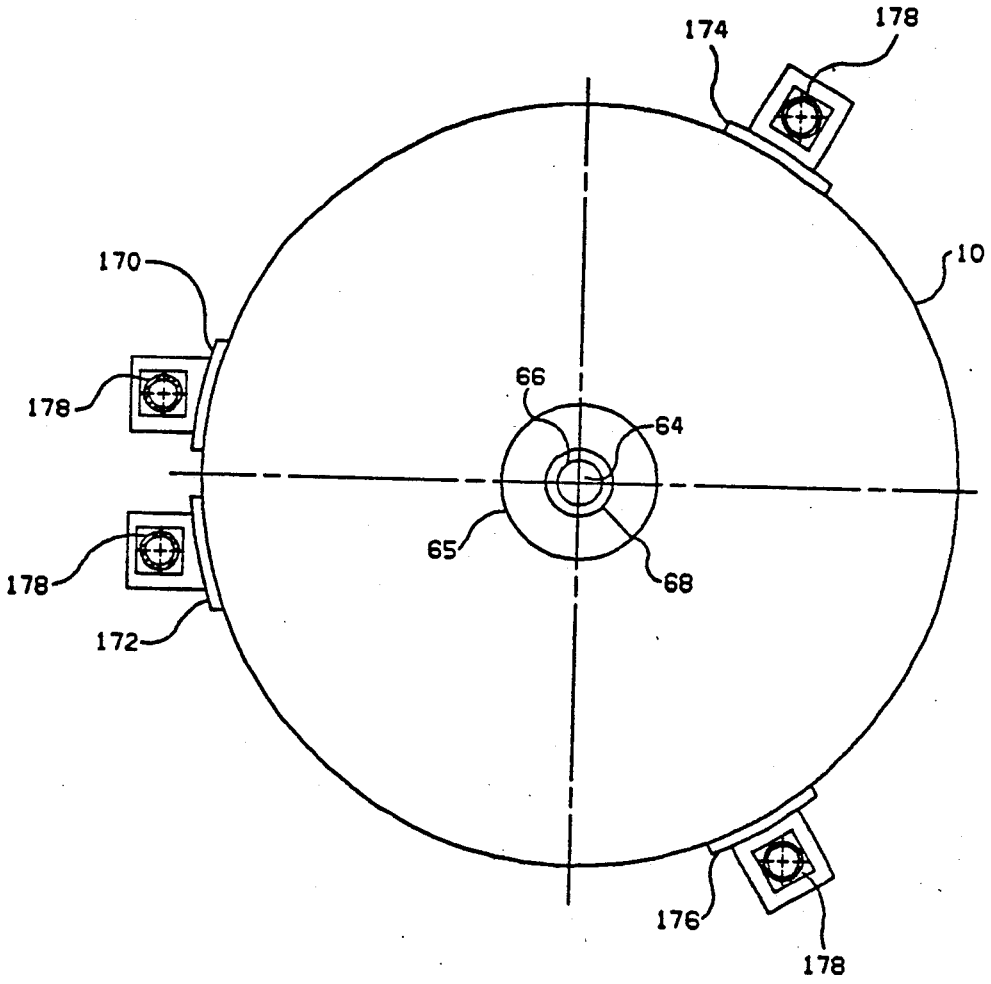
FIG. 5 is a sectional, plan view taken along the line 5—5 in FIG. 1.

The top head does carry a portion of the mixer load, namely the load due to a bearing member 62 which is attached to a pad 65 having an opening 66 (see FIGS. 5 and 6) lined by an insert 68 of corrosion resistant material. The opening 64 is in line with a central opening or nozzle opening 70 in the top wall 12 (see FIG. 6). A top plate 76 extends over side plates 78 between the side walls 64, 65. The bearing member 62 is a box having side plates 64 (see FIG. 3) which may have an access opening 72. The bearing member has a bottom flange 74 which is bolted to the pad 65.

The bearing member contains a seal assembly 80. Bearings in the top of the seal assembly 80 and floating bearing 96 counteract bending moments of the impeller shaft assembly 20. An extension 82 of the impeller shaft extends through the bearings 80 in the seal assembly. A seal cartridge 84 held by a retainer 86 in the assembly 80 thereof.

Flange type couplings 88 connect the impeller shaft 20 and the extension 82. There is a flange coupling 90 in the extension to facilitate seal cartridge replacement. There is also a flexible coupling 92 between the extension 82 and a spindle shaft 94. The mixer shaft 20, the extension 82, the spindle 94 and the couplings constitute the mixer shaft assembly.

The top of the bearing housing 62 contains the floating bearing 96 having a bearing element 98 which rotates and slides axially (in the direction of the axis of rotation 100 of the impeller assembly) in a cup 102. The bearing element 98 preferably has spherical roller bearings which bear against the inner periphery of the wall of bearing 96 enclosure (a cup). The bearing 96 may be lubricant (oil or grease) oil filled and oil seals 104 prevent escape of the lubricant which is injected into the cup through nipples 108. The upper seal 104 is in a closure plate 106 of the bearing 96. Tapered splints 110 lock the bearing element to the shaft extension 82 for rotation therewith. The upper flexible coupling 140 (see FIG. 7) is advantageous since it permits the shaft assembly to move axially. Such axial movement occurs during operation, as the tank 12 expands with increases in temperature and pressure contained therein.

Figure 7:
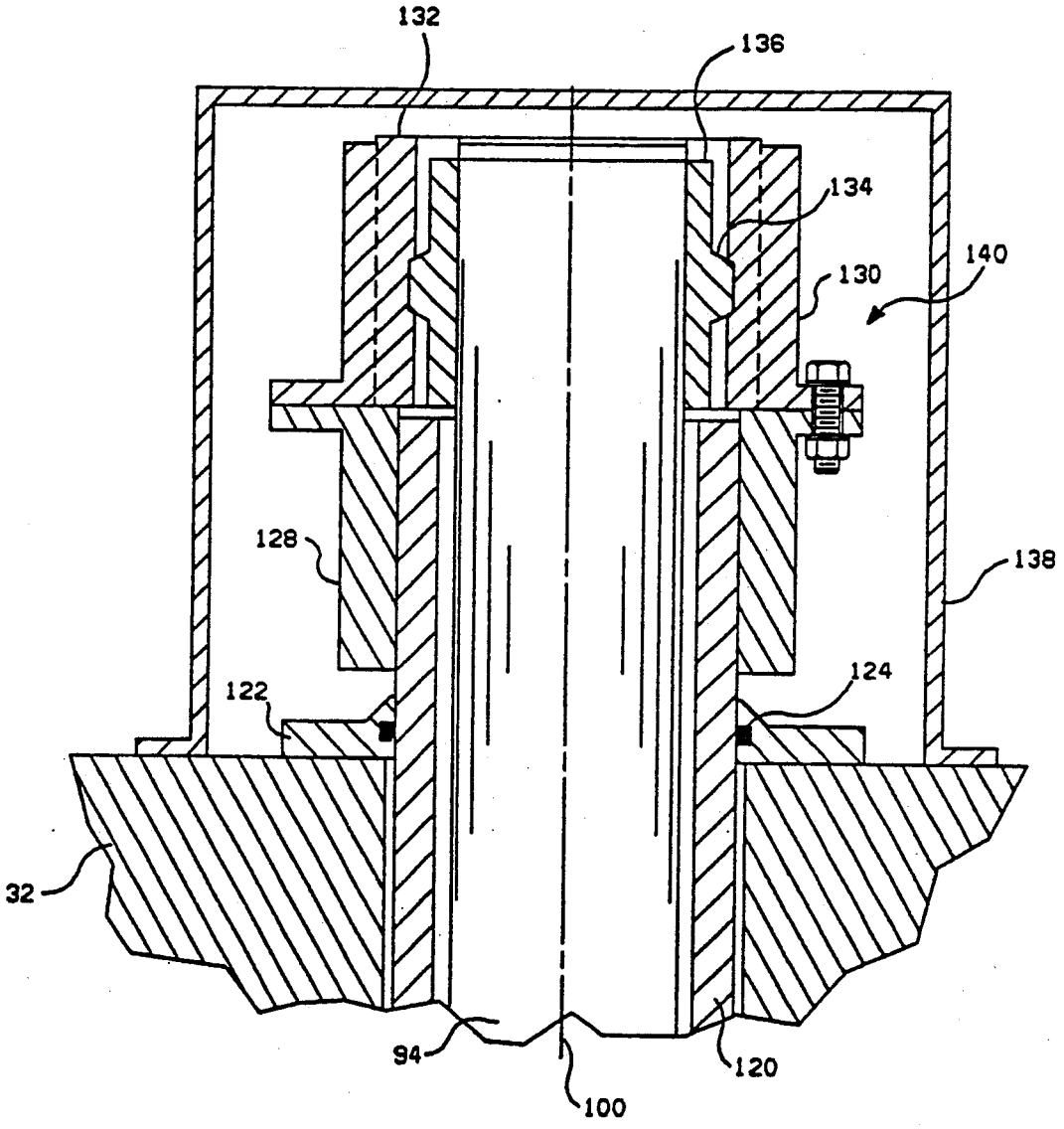
FIG. 7 is an enlarged sectional view of the mixing apparatus in the area denoted by the dash line 7 in FIG. 1.

The shaft assembly is in telescoping relationship with the transmission in the gear box 30; that is, the spindle shaft 94 is in telescoping relationship with the drive gears in the transmission. As best shown in FIG. 7, the output shaft 120 of the transmission extends up through the top 32 of the gearbox through a flange 122 having an oil seal 124 which contains the oil which fills the transmission. The output shaft 126 is connected to a gear coupling 140. This coupling employs a rigid coupling half 128 which is connected, as by an interference fit to the top of the output shaft 126. The rigid coupling half is bolted to a flexible coupling half 130 having splines 132 which are engaged by crowned gear teeth on an inner hub 136 attached to the upper end of the spindle 94. Thus, the spindle 94 and the entire shaft assembly can move up and down along the axis 100 a considerable distance. This movement enables the shaft assembly to move as the vessel expands due to temperature and pressure build-up therein and also allows the shaft assembly to be lifted for seal replacement, as will be explained below.

A guard 138 on the top 32 of the gear box 30 closes the axially movable gear coupler 140. A guard enclosure 142 is connected to and extends from the bottom of the machine base 36 to protect the flexible coupling 92. The coupling 92 isolates the mixer load, and particularly any bending moments which are transmitted through the floating bearing 96 from reaching the transmission through the spindle 94. Another flexible seal may be located in the top of the guard 142, around the spindle, for noise containment purposes.

A pin 148 is used for alignment of the bearing member 62 and the machine base. As shown in FIG. 1, the transmission, the opening 70 in the tank 10 are all in alignment and all parts are coaxial with the axis of the mixer shaft assembly which is the axis of rotation of the mixer shaft and the impeller 24 (see FIG. 1).

As noted above, only a small part of the load is carried by the top head of vessel. The majority (over 70%) of the load due to the mixer apparatus is carried by the side walls of the vessel 10 where the section modulus is the highest. This is accomplished by the use of support legs or columns 160, 162, 164 and 166. These columns depend from the bottom of the machine base 36 and are perpendicular (orthogonal) to the foundation 16. The columns 160 to 166 are tubular members having flanges 168 which are bolted to the flanges of the I beams 42 and 44 in case of the legs 160 and 162 respectively (see FIG. 8B) and to the webs of the cross beam 50 via the lower splice plate 58 (see FIG. 8A).

Figure 2:
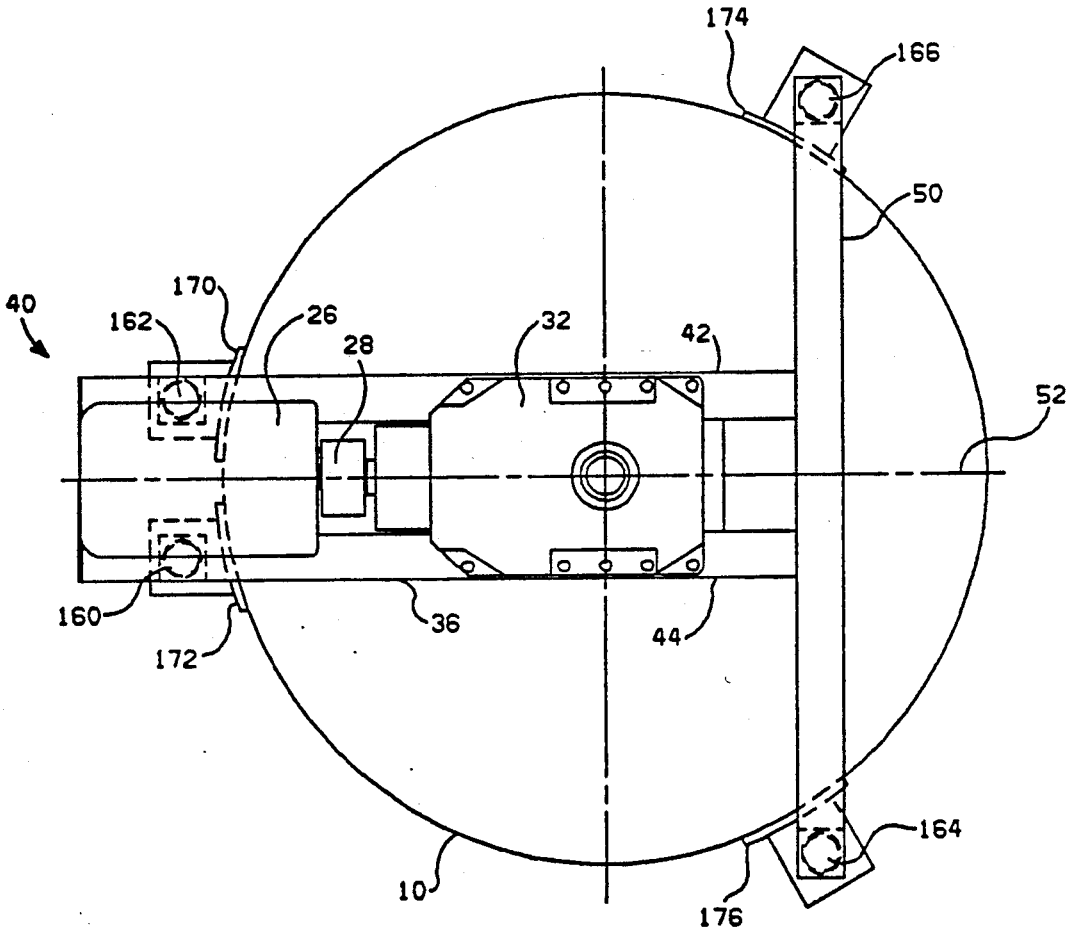
FIG. 2 is a plan view taken along the line 2—2 in FIG. 1.

The load due to the mixer assembly is distributed uniformly by an effective three point (120° apart) connection to the side wall of the vessel 10. As shown in FIG. 2, two of the legs are closely adjacent to each other and are adjacent to the left end of the trunk 40 of the base member. The other legs are at the ends of the cross beam 50 and are effectively at points 120° from a position between the legs 162 and 164 around the circumference of the vessel 10. The bottoms of the legs 162 to 164 have flanges for bolted connections to pads 170, 172, 174, 176. These pads are symmetrically disposed about the center line 52 of the trunk member 40 of the machine base 36. They are effectively (considering the pads 170 and 172 as being disposed along the intersection of the centerline 52 and the side wall of the vessel 10) 120° apart around the circumference of the side wall of the vessel. The load presented by the weight of the mixer apparatus and the torsional forces on the mixer shaft are distributed uniformly to the side walls and thence transferred downwardly to the foundation.

To make the connections to the legs 162 to 166, weldments, consisting of flanged cylindrical sections 178 having flanges to which the flanges at the lower ends of the legs 160 to 166 are bolted and gussets 180, are provided on each pad 170 to 176. Diagonal cross braces 182, 184, 186 and 188 are connected between the legs and the beams 42 and 44 of the trunk member and the cross beam, further stiffening the structural support for lateral and torsional loads and facilitating the transfer of these loads to the foundation via the legs 162 to 166.

Figure 6:
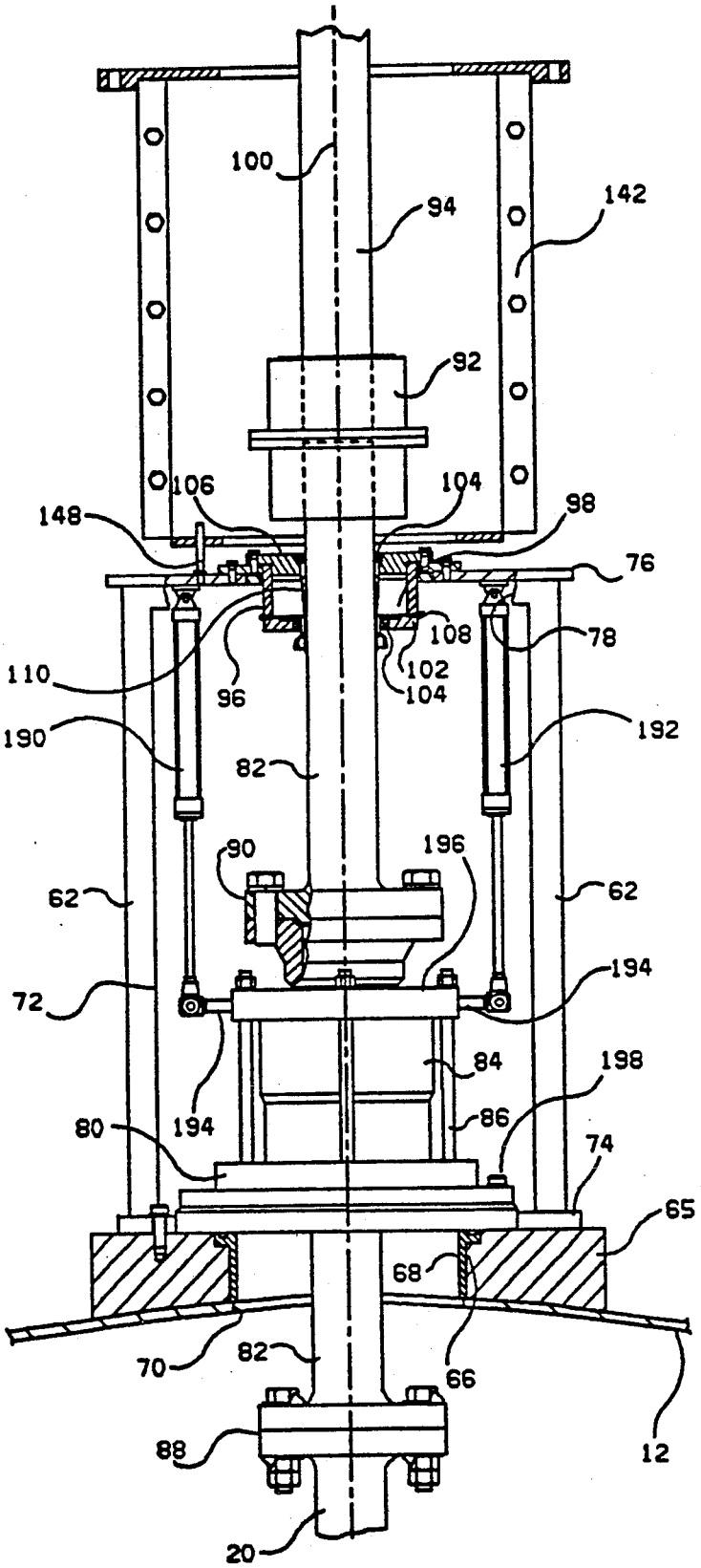
FIG. 6 is an elevational view showing the bearing member and shaft lifting mechanism in greater detail.

Referring to FIG. 6 there are shown two hydraulic cylinders 190 and 192. These cylinders are attached via pivot joints to the top plate 76 of the bearing member 62 and to posts 194 extending from each side of the top plate 196 of the seal assembly 80. In order to change the seal cartridge 84, the gear coupling guard 138 (FIG. 7) is detached and the gear coupling halves 130 and 128 are removed so as to free the spindle shaft 94 and the entire shaft assembly. The bolts 198 are removed. The hydraulic cylinders are pulled in. This raises the entire impeller shaft assembly. The flanged coupling 88 is pulled up above the pad 65. A support plate (not shown) which bridges the opening 70 is then attached at the coupling 88 so as to support the shaft 20 during seal replacement. The spindle 94 and extension 82 can be raised by unbolting the coupling 90 and the floating bearing 96. Then the seal cartridge 84 can be removed and replaced. The cylinders 190 and 192 are then lowered and the components reassembled in the position shown in FIG. 6.

From the foregoing description, it will be apparent that there has been provided improved mixer apparatus with a support structure to enable the installation of heavy, large mixer components as separate parts of the mixer apparatus making them readily accessible for maintenance and facilitating maintenance, especially seal replacement. A stiff, rigid support which prevents wobble and other vibration induced effects is also provided by the support structure. In the event that noise containment is desired, a box indicated by the dash line 200 in FIG. 1 may be disposed on the top of the trunk of the machine base 36 enclosing the motor coupling and transmission. This box may have an acoustic absorbing lining such as lead, and apertured walls providing a muffling structure or the like for noise containment. Other variations and modifications in the herein described system, within the scope of the invention, will undoubtedly suggest themselves to those skilled in the art. Accordingly, the foregoing description should be taken as illustrative and not in a limiting sense.

We claim:

1. Mixer apparatus which is supported by a support structure on a vessel which apparatus comprises an impeller attached to an impeller shaft driven by a motor through a transmission which presents a load on the vessel, the vessel having a side wall, a base resting on a foundation and a top head in which vessel material is mixed by said impeller, which load is greater than the load which top head of said vessel can support without vibration which can cause wobbling of the mixer apparatus and can cause catastrophic damage to the vessel during mixing of said material when the mixer apparatus is totally supported on said top head, said support structure comprising a base on which said motor and transmission are disposed and from which said mixer shaft depends into said vessel and disposes said impeller therein, a plurality of columns extending vertically in the same direction as said impeller from said base to a plurality of locations spaced from each other around the periphery of said side wall of said vessel, and said legs having ends presenting connections to said side wall of said vessel for distributing said load through said side wall to said foundation.

2. The apparatus according to claim 1 wherein said locations are approximately 120° apart around the circumference of said tank.

3. The apparatus according to claim 1 wherein said base has a longitudinal trunk having opposite ends and a cross member orthogonal to said trunk and attached thereto in the vicinity of one of said opposite ends, said columns being attached to said cross member in depending relationship therewith at locations on opposite sides of said trunk and to said trunk in the vicinity of the other of said opposite ends in the pending relationship therewith.

4. The apparatus according to claim 3 wherein a first pair of columns are spaced from each other laterally of said trunk member adjacent to said other of said opposite ends of said trunk member, and a second pair of columns are spaced from each other each adjacent in opposite end of said cross member.

5. The apparatus according to claim 4 further comprising cross braces between each of a first pair of said columns and said trunk.

6. The apparatus according to claim 4 further comprising braces extending diagonally between each of said second pair of columns and said trunk.

7. The apparatus according to claim 3 wherein said motor and transmission are disposed on said trunk member.

8. The apparatus according to claim 6 wherein said vessel has a top head having an opening therein providing an entrance into said vessel, said impeller shaft having an extension extending upwardly from said impeller shaft, said extension providing a spindle, said extension and said spindle being disposed along the same axis, said axis extending to said transmission, means connecting said spindle in driving relationship with said transmission and for enabling telescoping movement of said spindle shaft with respect to said transmission.

9. The apparatus according to claim 8 wherein said connecting means comprises a gear coupling disposed on said transmission in coaxial relationship with said spindle, and said spindle being connected to said gear coupling.

10. The apparatus according to claim 9 further comprising a flexible, floating coupling between said spindle and shaft extension.

11. The apparatus according to claim 8 further comprising a bearing member on said top head, said shaft extension being disposed in said bearing member, said bearing member having a top plate and a bottom, means providing a rest for said bearing member being disposed on said top head around said opening, a seal unit disposed on said bottom of said bearing member in assembled relationship with said shaft extension, means connected between said seal unit and said top plate of said bearing member for raising said seal unit to enable seal replacement therein.

12. The apparatus according to claim 11 wherein said raising means comprises a pair of hydraulic cylinders.

13. The apparatus according to claim 11 further comprising a bearing element attached to said top of said bearing member in which said shaft extension is journaled, said bearing element being attached to said shaft extension and being axially moveable therewith.

14. The apparatus according to claim 6 further comprising noise containment means mounted on said trunk member for containing noise generated by said motor, transmission and coupling and couplings there between.

15. The apparatus according to claim 14 wherein said mixer apparatus and said support structure thereof weigh over 80,000 pounds.

* * * * *